US006116979A

United States Patent [19]

Weber

[11] Patent Number: 6,116,979

[45] Date of Patent: Sep. 12, 2000

[54] ASSEMBLABLE SYMMETRICAL BODIES

[76] Inventor: Jean-Marc Weber, Haldenstrasse 15, CH-8620 Wetzikon, Switzerland

[21] Appl. No.: 09/229,790

[22] Filed: Jan. 13, 1999

[30] Foreign Application Priority Data

May 15, 1998 [CH] Switzerland ..... 1080/98

[51] Int. Cl.[7] ..... A63H 33/04

[52] U.S. Cl. ..... 446/92; 273/157 R

[58] Field of Search ..... 446/85, 92, 126, 446/901; 273/157 R; 52/DIG. 10

[56] References Cited

U.S. PATENT DOCUMENTS

| | | | |
|---|---|---|---|
| 2,987,318 | 6/1961 | Hammer | 273/157 R |
| 3,659,360 | 5/1972 | Zeischegg | 273/157 R X |
| 4,593,908 | 6/1986 | Ibrahim | 52/DIG. 10 |
| 5,100,359 | 3/1992 | Gorio | 273/157 R X |
| 5,217,226 | 6/1993 | Christopher | 273/157 R |
| 5,340,349 | 8/1994 | Berg-Fernstrum | 446/85 X |
| 5,411,262 | 5/1995 | Smith | 273/157 R |
| 5,544,882 | 8/1996 | Sarkar | 273/157 R |
| 5,826,872 | 10/1998 | Hall | 273/157 R |
| 5,842,697 | 12/1998 | Scott et al. | 273/157 R |
| 5,895,044 | 4/1999 | Bahramian | 273/157 R |

FOREIGN PATENT DOCUMENTS

| | | | |
|---|---|---|---|
| 2267228 | 12/1993 | United Kingdom | 446/85 |

*Primary Examiner*—D. Neal Muir
*Attorney, Agent, or Firm*—Jenkens & Gilchrist, P.C.

[57] ABSTRACT

The present invention relates to assemblable symmetrical bodies consisting of a regular central body (1–5, 6–8, 26) and a multitude of partly congruent covering pieces (9, 23). Fasteners (18, 19) are firmly fixed to the central body (1–5, 6–8, 26), or to the basic surface (10) of each of the covering pieces (9, 23) respectively, providing a relatively firm connection between the regular central body (1–5, 6–8, 26) and the covering pieces (9, 23) which can be broken and re-established as often as desired using relatively little force. The covering pieces (9, 23) may be shaped like jigsaw puzzle pieces (27, 28) containing projections (34) and matching cut-outs (31).

12 Claims, 6 Drawing Sheets

ASSEMBLABLE SYMMETRICAL BODIES

BACKGROUND OF THE INVENTION

The present invention relates to a body with a multiplicity of axes of symmetry, which can be assembled from various body parts, as a rule partly congruent with each other, in accordance with the claims.

Constructional bodies are known in many different forms of production, for instance as a toy in the form of small building blocks, which are put together by fastening means in the most diverse ways, and can be made into the most diverse new forms, for instance even into the form of a new, larger block. As assembly toys there are further constructional bodies, whose parts are relatively flat and which can either be laid next to each other in different aesthetically attractive shapes, or which can only be put together exactly in one or perhaps in a few correct ways. Such devices are not only suitable as pastimes, but they can, when provided with a suitable printed message, be applied as efficient advertising carriers, since because of its constructional nature several persons will allow themselves to be induced to occupy themselves playfully with this object for a longish time, whereby the message to be conveyed is better accepted.

The disadvantage of the constructional bodies listed above is that the end product itself either has many corners, or that it is not stable and in its assembled form cannot be kept or set up in a space-saving manner, as is the case with an assembly toy.

The aim which is to be addressed by the present invention, is to produce a constructional body with many axes of symmetry, which comprises different part bodies, which are as a rule mutually congruent in groups, which can be put together in exactly one or a few correct ways and which avoids the disadvantages noted above.

The addressing of the aim is given in the claims with regard to various forms of construction. The solution is further explained in the following Figures.

BRIEF DESCRIPTION OF THE DRAWINGS

Shown are

DETAILED DESCRIPTION OF THE INVENTION

Figure 1:
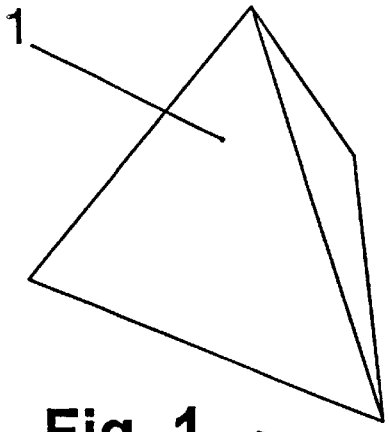
FIGS. 1*a* to *f* various simple forms of construction of the central body.
Figure 1C:
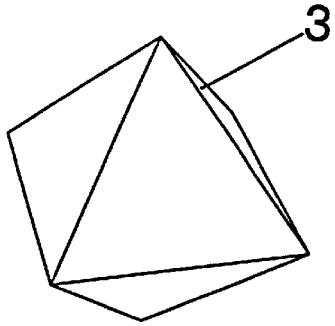
Figure 1:
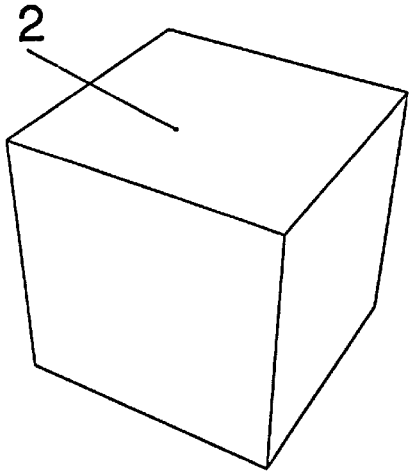
Figure 1:
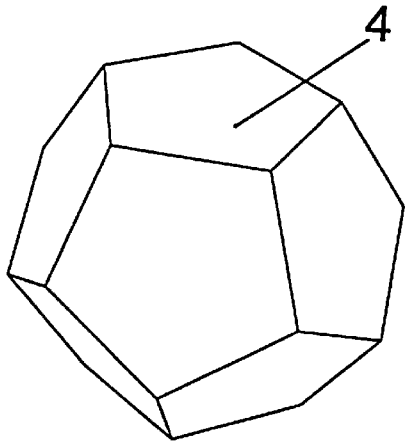
Figure 1E:
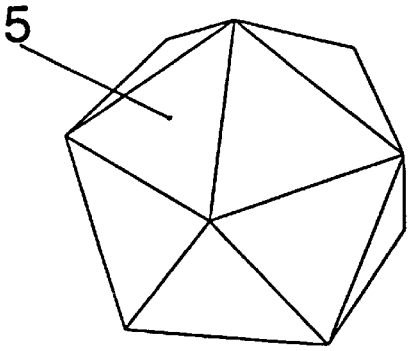
Figure 1:
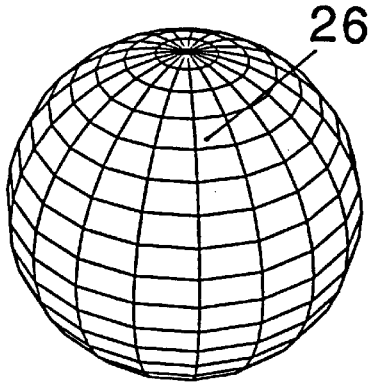

In FIGS. 1*a* to *e,* different simple forms of construction of the central body are shown, which are bordered by a number of regular congruent triangles, quadrilaterals or pentagons. The known platonic bodies tetrahedrons 1, cubes 2, octahedrons 3, dodecahedrons 4 and icosahedrons 5 result from this. A sphere 26 shows a limit condition in FIG. 1*f.* It also is suitable as a central body. The group of, in each case, associated, mutually congruent covering bodies 9 is further examined below.

Further central bodies result from the bodies 1 to 5, by cutting back all their corners up to a certain fraction of the length of the edges.

Figure 2A:
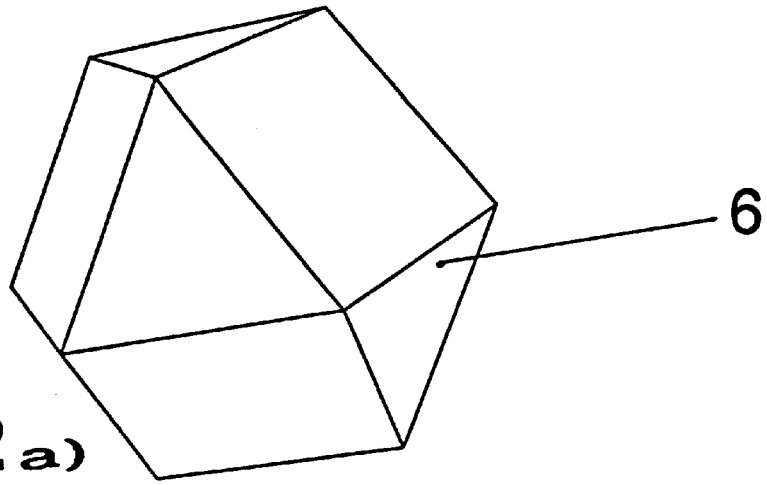
FIGS. 2*a,b,c* three selected central bodies derived from simple constructional forms, FIG. 3 a partly dismantled body according to the invention, with a cube as the central body, FIG. 4 a form of construction of a covering piece matching a central body in the form of a dodecahedron, FIG. 5 a first form of construction of a connection between a covering piece and the central body, FIGS. 6–8 three different further divisions of the covering piece shown in FIG. 4
Figure 2B:
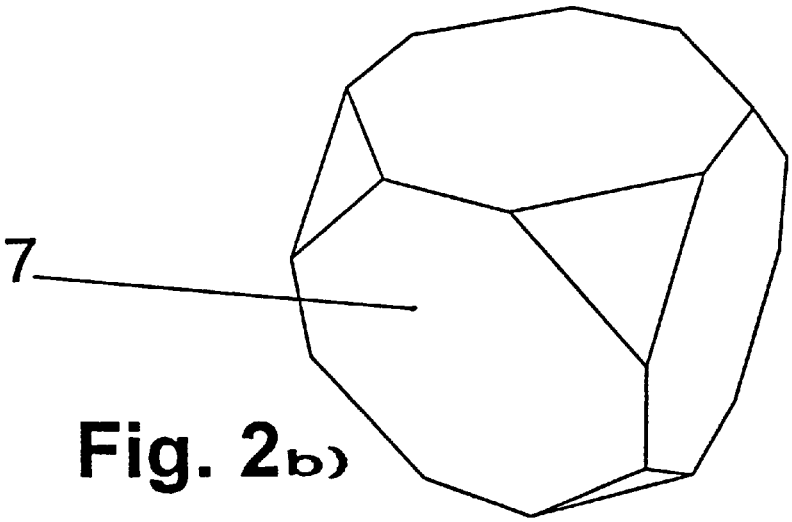
Figure 2C:
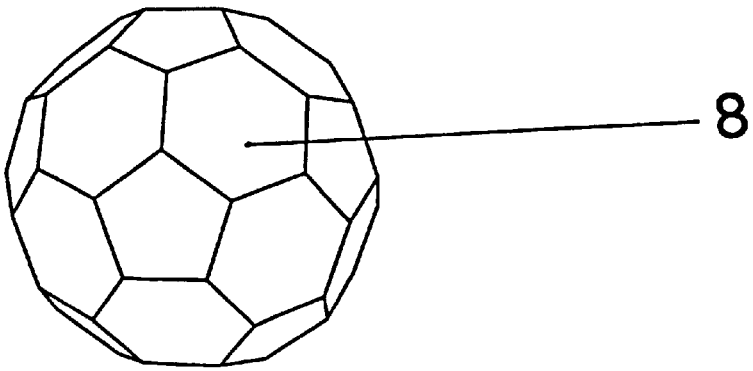

In FIGS. 2*a, b, c,* three examples are shown from the multiplicity of the further possibilities derived from the simple forms of construction of the central body, to which all the bodies known as Archimedian solids belong. If, for instance, in a cube all the corners are removed up to a fraction of B=50% of the edge length, there arises as in FIG. 2*a* a so-called middle crystal 6. At a fraction of B=25%, there appears a corresponding intermediate body 7 as in FIG. 2*b.* If all the corners of a icosahedron 5 are removed to 33%, the truncated icosahedron 8 shown in FIG. 2*c* arises. By continuous changing of the fraction B between 0 and 50% there appear for each of the platonic bodies a multiplicity of unendingly many different central bodies, whose outlines comprise symmetrically arranged, regular polygons with different numbers of corners. It is common to all these central bodies arising in this way, that all of their corners lie on a circumscribed sphere, not drawn here.

To these central bodies belong two groups of covering pieces 9, each mutually congruent, for example for the middle crystal 6, a first group of eight covering pieces 9 with an equilateral triangle as the basic surface, and a second group of six covering pieces 9 with a quadrilateral of equal length sides as the basic surface, which is also discussed in greater detail below.

Figure 3:
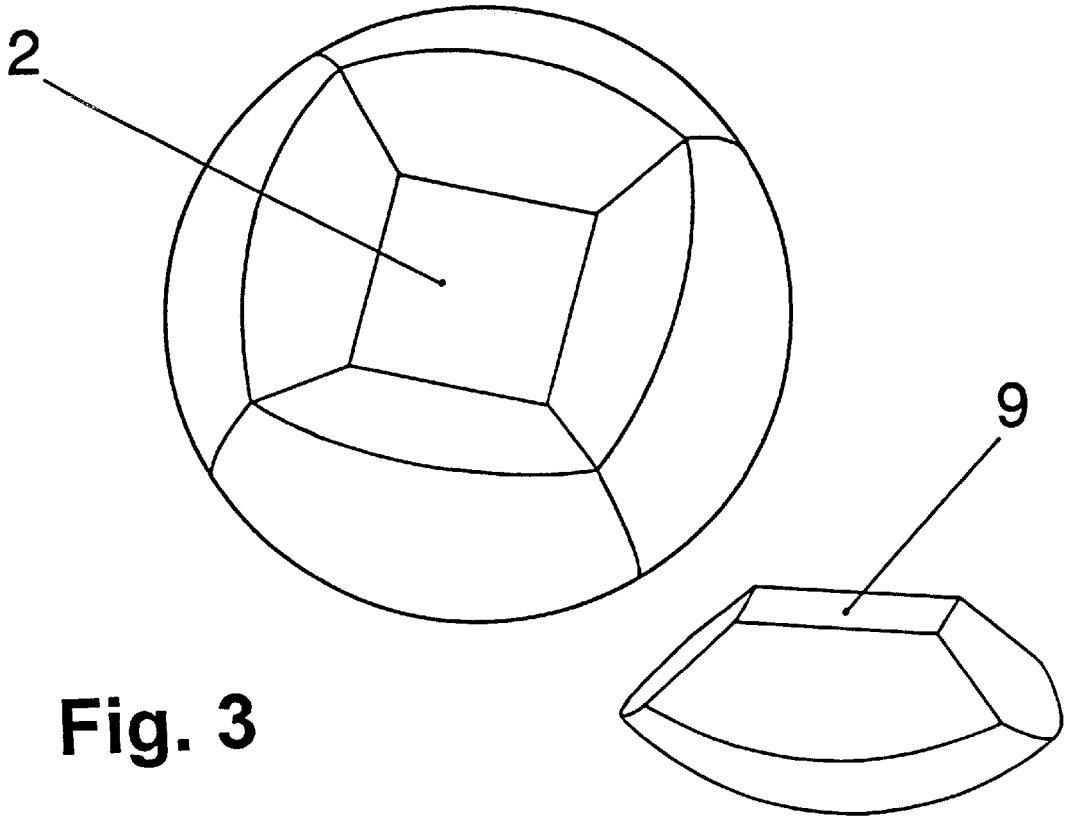

FIG. 3 shows, in a perspective view, a partly disassembled body according to the invention with a cube 2 as the central body. Of the six covering pieces 9 one is here taken out from the body, and is depicted in this FIG. 3 lying alongside the no longer complete body. The opening thus arising provides a clear view onto the surface of the central body, thus here onto one of the squares of the cube 2, onto the side surfaces of the covering piece 9 removed and onto some of the side surfaces of the remaining covering pieces 9 still joined to the central body. These surfaces can all be printed or otherwise provided with text, pictures, logos or patterns.

Figure 4:
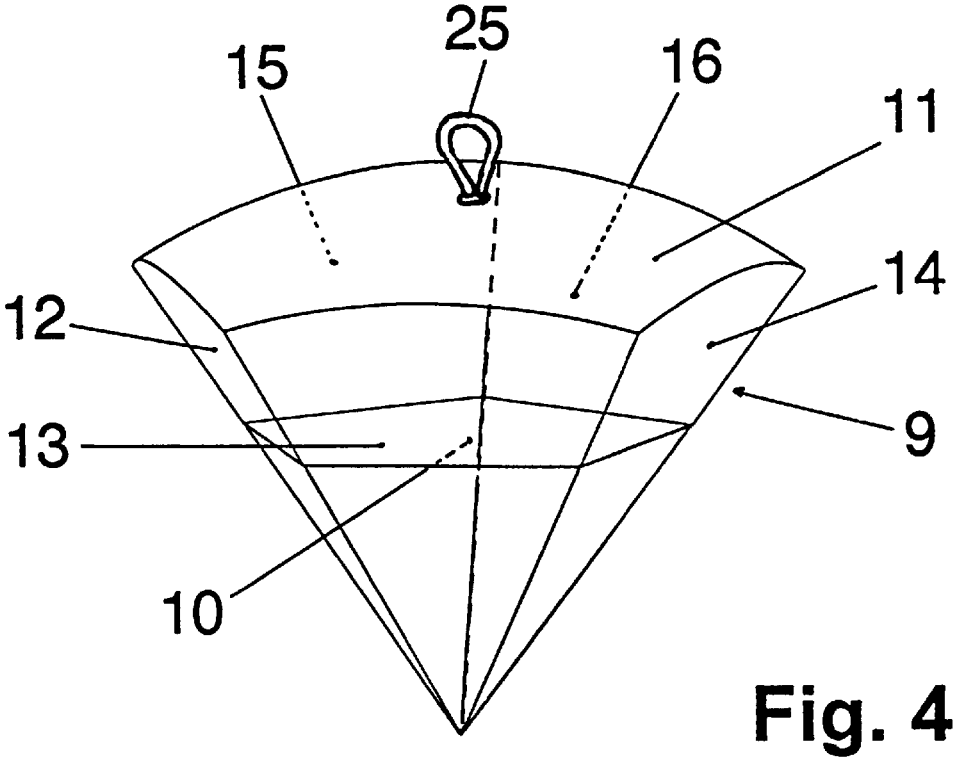

In FIG. 4 a form of construction of a covering piece 9 is shown, which fits a central body in the form of a dodecahedron 4. It belongs to an individual group of twelve mutually congruent covering tiles 9. It is bordered by a basic surface 10 in the form of a regular pentagon, which is essentially congruent with the surfaces of the dodecahedron 4. This covering piece 9 is further bordered by a regular spherical pentagon as covering surface 11 on the surface of a second sphere, concentric with a circumscribed sphere of the dodecahedron, with a greater but otherwise undefined radius, whereby each of the corners of this spherical pentagon lies on one of the five rays, which start in the centre of the sphere and pass through the corresponding corners of the basic surface 10. Between the basic surface 10 and the spherical pentagon shaped covering surface 11 the covering piece 9 is further bordered by five mutually congruent surface pieces 12–16. To improve visibility, the surface pieces 12, 13 and 14 are shown as partly transparent and the whole covering piece 9 as a hollow body. The use of hollow covering pieces 9 is similarly, however, obviously in accordance with the invention, indeed for the ability to assemble the body the outer shape is important above all. Each of these surface pieces 12–16 is bordered by one side of the basic surface 10, by the two distances between the end points of this side and the corners in each case of the spherical pentagon, and by the smaller great circle arc onto the second sphere through these two corners of the spherical pentagon.

Not drawn, but similarly in accordance with the invention is if the basic surface 10 is formed not as a flat surface, but as a spherical pentagon through these five corner points on the circumscribed sphere of the dodecahedron. This means in other words that the dodecahedron 4 is replaced by a sphere 26, retaining the remaining spatial division of the group of the covering pieces 9. Conversely the spherical pentagon of the covering surface 11 can be replaced by a flat pentagon through the same five points, or both the covering surface 11 and also the basic surface 10 can be formed as regular flat pentagons, whereby the covering piece 9 receives the form of a truncated pyramid and the surface pieces 12–16 receive the form of equilateral trapeziums. The arrangement according to the invention comprises in this form of construction twelve congruent covering pieces 9 of the type described above and a dodecahedron 4 matching them, as the central body. At least one of the covering pieces 9 includes means, to be able to remove this covering piece 9 as the first to be able to be released from the completely assembled body, here for instance a grommet 25 extending outward from the surface.

Figure 5:
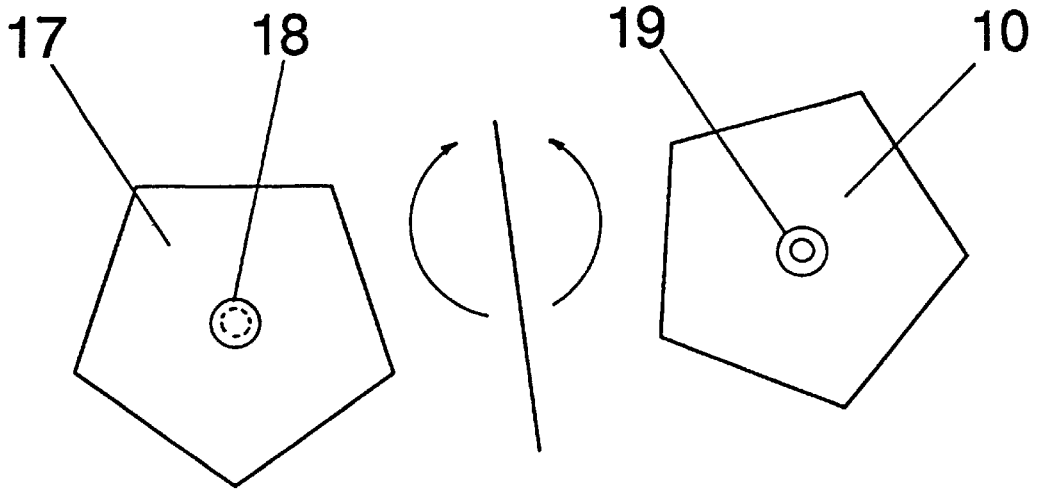

In FIG. 5 is shown a first form of construction of a connection between the basic surface 10 of the covering piece 9 and any desired surface 17 of the dodecahedron 4. The surface 17 and the basic surface 10 include joining means, with which a firm connection, but releasable with a small exertion of force, between the dodecahedron 4 and the associated covering piece 9, can be produced. The fastening means comprise here a press stud 18, which is placed in the centre of the surface 17. It is lightly sunk into the surface 17 and is firmly joined to it and thus to the dodecahedron 4. In the basic surface 10 the associated mating piece 19 of the press stud 18 is similarly firmly fixed to the covering piece 9. By placing the mating piece 19 onto the press stud 18 and a following light pressure of the pieces against each other the dodecahedron 4 and this covering piece 9 are brought into a relatively firm connection, which can however be released again without the exertion of great force. An exchange of the positions of the press stud 18 and the mating piece 19 is naturally also in accordance with the invention, similarly the use of more than one, for instance three press studs. In a further modification, not shown, instead of the press stud 18 and its mating piece 19 a VELCRO hook and grommet fabric fastener is used, for example such that its hook part is glued to the basic surface 10 and its grommet part to the surface 17, or vice versa. In a third, likewise not shown, modification, instead of the press stud 18 and its mating piece 19, magnets with opposing polarities are applied. Magnetic forces are also applied in a further modification, in which magnetic foils are glued to the basic surface 10, whilst on the surface 17 similarly, magnetic foil or simply a layer of a suitable ferromagnetic material is applied, or vice versa. In a fourth modification instead of the press stud 18 and its mating piece 19 a releasable glue band is applied.

The matter set out above applies for every central body represented as examples in FIG. 1 or FIG. 2. Each of these central bodies requires covering pieces 9 matching it in form and quantity. Each of these covering pieces 9 has n-fold axes of symmetry. Each of these covering pieces 9 can now be subdivided into n further, no longer necessarily symmetrical, but still congruent lesser covering pieces 23, which then form a new, individual group of covering pieces.

Figure 6:
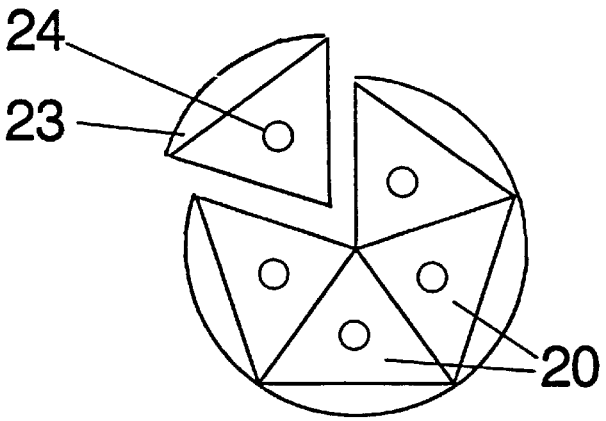
Figure 7:
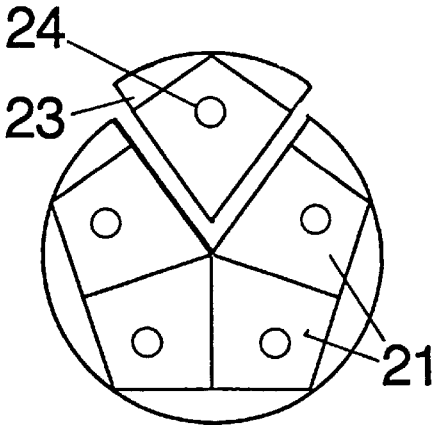
Figure 8:
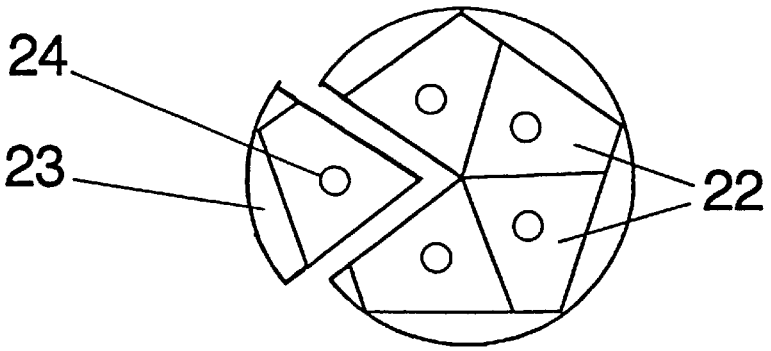

In FIGS. 6 to 8 this is shown on the example of the covering piece 9 described in FIG. 4, which has a five-fold axis of symmetry, for which thus n=5. The transfer to other covering pieces 9 is obvious, for which reason a detailed presentation for other covering pieces 9 can be omitted here. A view is shown looking towards the centre point of the sphere, whereby the covering piece 9, in schematic representation, is presented roughly as a regular pentagon.

In FIG. 6 a first further subdivision is undertaken, in which the regular spherical pentagon of the covering surface 11 is divided into five isosceles congruent spherical triangles 20.

In FIG. 7 a second further subdivision is undertaken, in which the regular spherical pentagon of the covering surface 11 is divided into five spherical kite quadrilaterals 21.

In FIG. 8 a third further subdivision is shown into yet more common spherical quadrilaterals 22.

In an analogue manner, where n=4, the covering piece 9 can be divided into four congruent, right-angled isosceles spherical triangles, into four congruent spherical squares or into four more general spherical quadrilaterals. In a similar analogue manner, for n=3 the covering piece 9 can be divided into three congruent, isosceles spherical triangles, into three congruent spherical kites or into three more general spherical quadrilaterals. Naturally each of these sub-parts requires its own fastening means, for instance an individual press stud 18 with corresponding mating pieces 19 on the central body, as is indicated in FIGS. 6–8 by circles 24. Obviously here also any other suitable fixing means desired can be employed, as has been given in the examples above. A further subdivision of the lesser covering pieces 23 into still smaller units or into non-congruent lesser covering pieces 23 is indeed also according to the invention. Such a division is however practically of small importance because of the increasing expenditure for its production and the quickly increasing expenditure of time for the playful assembly of the parts into a complete body.

Figure 9:
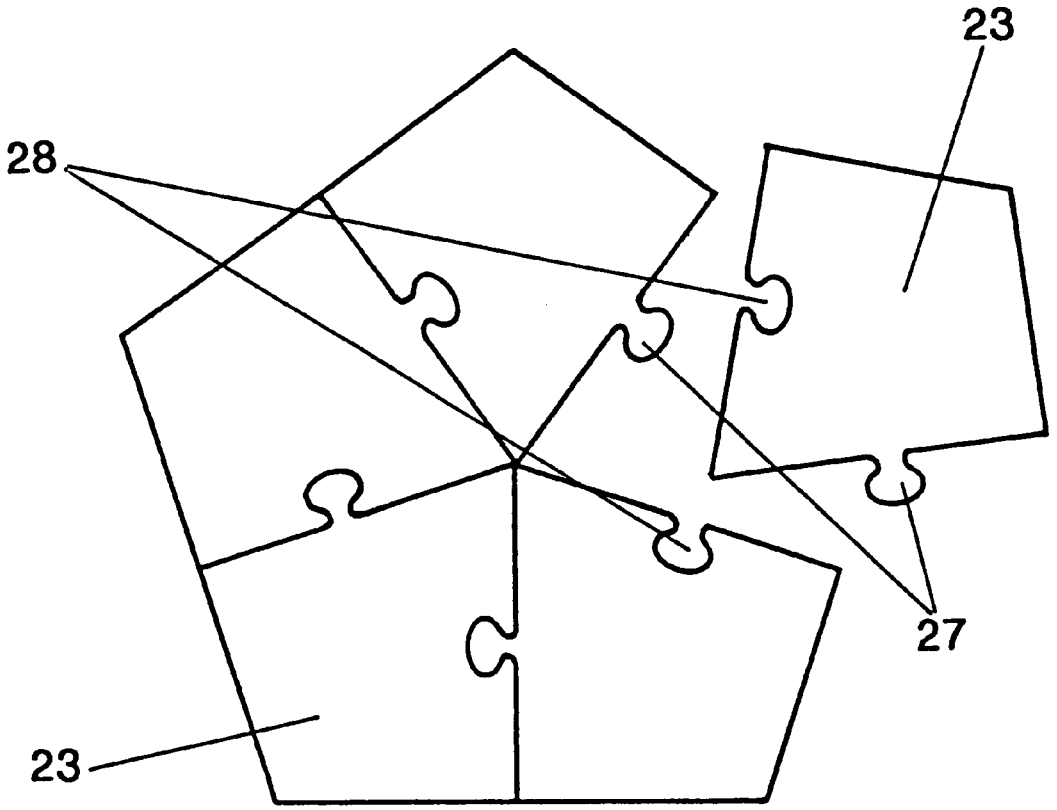
FIG. 9 a fourth further division with development of subdivisions of a covering piece as a jigsaw puzzle piece, and FIG. 10 the development of a fifth further division, which includes additional cut-outs and outward projections on the edges of the covering part.

In FIG. 9 a fourth further subdivision of the covering pieces 9 into smaller pieces 23 is shown. On at least two of the subdivided pieces 23 one includes at least one projection 27 and the other at least one opposite and equal cut-out 28, whereby these lesser pieces 23 are formed as interlocking jigsaw puzzle pieces. Obviously more than only one projection and one cut-out 27, 28 are in accordance with the invention.

Figure 10:
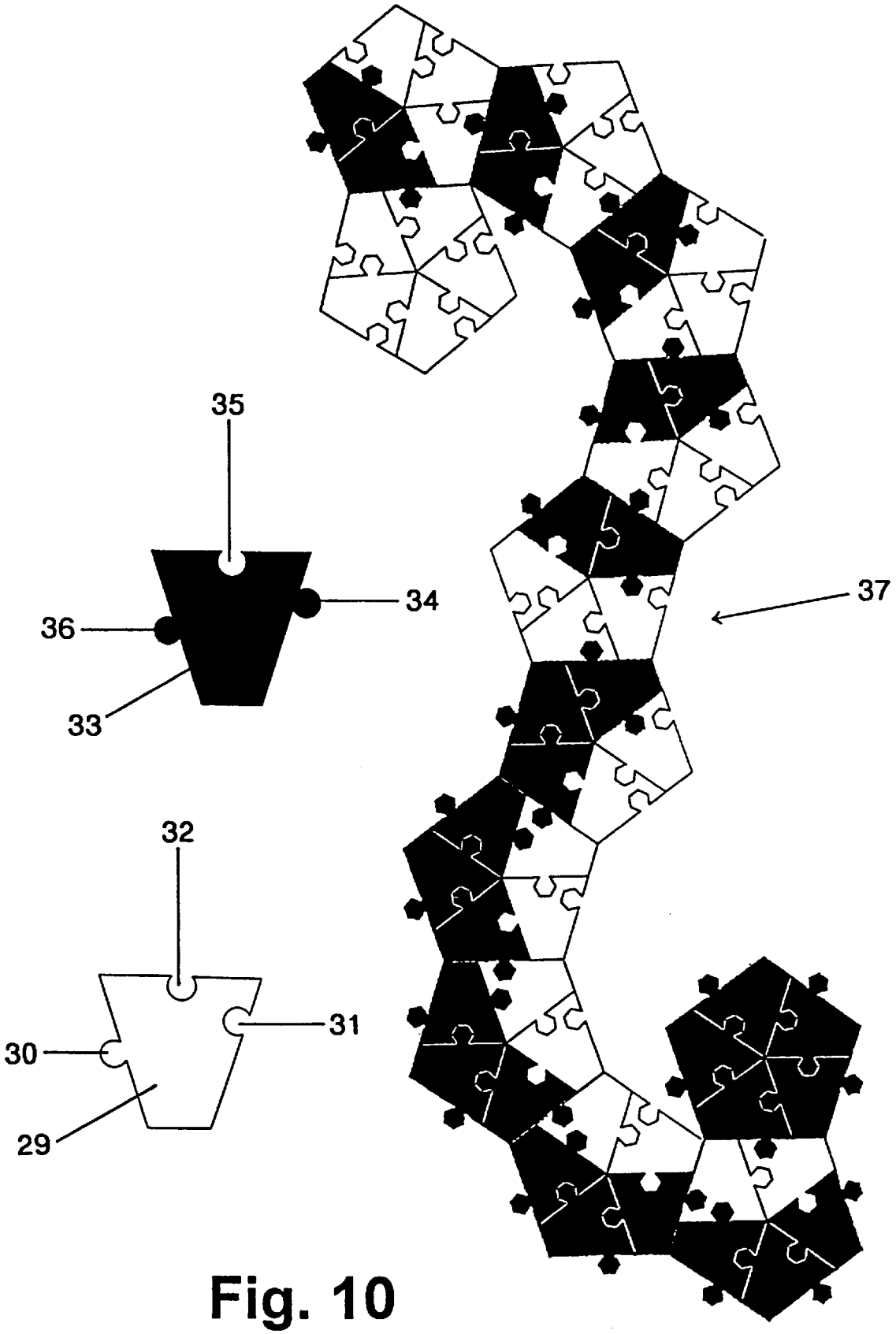

FIG. 10 shows the development 37 of the surface of a dodecahedron with a fifth further subdivision of the covering pieces 9 into non mutually congruent lesser pieces 23, namely into lesser pieces 29 and 33. In this subdivision additionally projections and cut-outs arise on the borders of the covering pieces 9 themselves. The twelve covering pieces 9 are assembled as matching combinations of in each case five selected lesser pieces 29 or 33. For the overall body a total of thirty lesser pieces 29 and thirty lesser pieces 33 are necessary. Each of the individually depicted surfaces of the two lesser pieces 29, 33, seen facing away from the central point of the overall body, has the form of an isosceles trapezium with basic angles of 72°, whereby the base is of equal length to each of the legs. The first lesser piece 29, drawn in white in FIG. 10, has a cut-out 31, 32 in one of its legs and in its base and a projection 30 on its other leg. The second lesser piece 33, drawn in black in FIG. 10, has a projection 34, 36 in each of the legs of the trapezium and a cut-out 35 in the base of the trapezium. The shape of the cut-outs and projections is determined thereby, that the cut-outs and projections 30, 32, 35 and 36 are essentially congruent, as are the cut-outs and projections 31 and 34 between each other, and that each of the projections 30, 34 and 36 and can be pushed into the associated cut-outs 31, 32 and 35 in each case.

Using forms of the cut-outs and projections 30–32 and 34–36 which reduce toward the centre point of the overall body, increases the stability of the overall body, and it can be that the use of the inner body can even be dispensed with.

The relative positions of the cut-outs and projections 30, 36, 32 and 35 and 31 and 34 respectively can be chosen in each case freely within the length of the touching sides of the trapeziums. With the overall body assembled, the side surfaces of the lesser pieces 29 and 33 lie in planes, which also include in each case the centre point of the overall body. If in the assembly of the lesser pieces 29, 33 a start is made with five lesser pieces 29 according to the development 37, the whole body can be put together without difficulty.

The use of mirror images of the lesser pieces 29 and 33 as shown is naturally also according to the invention and leads to a mirror image of the overall body.

Suitable divisions of the covering pieces 9 into lesser pieces are also possible with the other central bodies 1–3, 5, 6–8 and 26 and can be realised in an obvious manner, for which reason their presentation can be dispensed with here.

As material for the central bodies 1–5, 26, 6–8 and the covering pieces 9 as well as the lesser covering pieces 23, many metals and a large number of plastics materials come into question as well as natural materials such as, for instance, wood. The techniques for printing, writing or painting of the parts 1–5, 26, 6–8, 9 and 23 will not be discussed here, but there are many well known and tried processes for this available to the specialist. At least one of the covering pieces 9 and of the lesser pieces 23 includes means, whereby this piece can be easily be taken out from the completely assembled body, for example, a finger opening in its covering surface 11, a grip extending out from the covering surface 11 or a grommet 25, extending out from the covering surface 11 as shown in FIG. 4.

It is similarly in accordance with the invention if only one part out of all the covering parts 9 or 23 can be separated out from the central body, whilst the others remain joined to it firmly, for example also because they are made, together with it from a single piece of material.

What is claimed is:

1. A constructional body with a multiplicity of axes of symmetry, comprising:

a central body, at least one group of mutually congruent covering pieces (9), exactly sufficient in number to cover this central body completely, wherein:

the central body is a regular solid (1–5, 6–8, 26), all the covering pieces (9) are further comprised by a basic surface (10), a covering surface (11) and to the sides by a number of surface parts (12–16), the basic surface (10) of each covering piece (9) is essentially congruent with an associated surface (17) of the central body, lies upon it without any intervening space and can be joined to it, on at least one of the covering pieces (9) and on the central body, fastening means (18, 19) are present and are firmly fixed to the basic surface (10) and to the associated surface (17) of the central body respectively, with which the connection between the central body and the covering piece (9) belonging to it can be broken and re-established as often as desired using relatively little force, each of the surface parts (12–16) of any covering piece lies essentially without any intervening space between said surface part and a side surface (12–16) of a neighbouring covering piece (9), whereby the central body is completely enclosed and joined to a group of covering pieces covering pieces (9) firmly, but in the case of at least one of the covering pieces (9) easily loosened, and at least one of the covering pieces (9) has a projection (34) on one of its side borders and at least one other of the covering pieces (9) has a matching cut-out (31) on one of its side borders whereby the covering pieces may be interlocked.

2. A constructional body according to claim 1, at least one of the covering pieces (9) is divided into at least one group of lesser covering pieces (23), at least one of these lesser covering pieces (23) has its own means of fastening (18, 19).

3. A constructional body according to one of the claims 1 or 2, wherein:

instead of the regular central body (1–5, 6–8) a sphere (26) is present, the basic surfaces (10) of the covering pieces (9, 23) are spherical polygons, these spherical polygons lie on the sphere (26).

4. A constructional body according to one of the claims 1 or 2, wherein the covering surface (11) of at least one of the covering pieces (9, 23) is flat.

5. A constructional body according to claim 2, wherein at least two lesser pieces (23) of a covering piece (9) one includes at least one projection (27) and the other at least one cut-out (28), whereby these lesser pieces (23) are shaped like jigsaw puzzle pieces.

6. A constructional body according to claim 1, wherein the covering pieces (9) match a dodecahedron (4) as the central body, each of the twelve covering pieces (9) comprises a combination of five selected and assembled lesser pieces (29, 33) from two lesser pieces (29, 33), each of these twelve lesser pieces (29, 33) has an outward facing surface, which has the shape of an isosceles trapezium with base angles of 72° and whose base is the same length as each of the legs, the first lesser piece (29) has a cut-out (31, 32) in each of one of its sides and the base, and a projection (30) on its other leg, the second lesser piece (33) has a projection (34, 36) on the legs of the trapezium and a cut-out (35) in the base, each of the projections (30, 34, 36) of each of the lesser covering pieces (29, 33) can be pushed into a cut-out (31, 32, 35) allocated to it in another of the lesser covering pieces (29, 33), each of the projections (30, 34, 36) is essentially congruent with the cut-out (31, 32, 35) allotted to it.

7. A constructional body according to claim 1, wherein the fastening means (18, 19) comprises at least one press stud (18) and at least one corresponding mating piece (19).

8. A constructional body according to claim 1, wherein the fastening means comprises a hook and grommet fabric fastener.

9. A constructional body according to claim 1 wherein the fastening means comprises at least one magnet.

10. A constructional body according to claim 1 wherein the fastening means comprises a releasable glue strip.

11. A constructional body according to claim 10, characterised in that at least one of the releasable covering pieces (9, 23) includes grasping means (25) by which a directing force can be exerted away from the centre of the body, which is greater than the force with which this covering piece (9) or this lesser covering piece (23) is held together with the central body (1–8) by the fastening means (18, 19).

12. A constructional body according to claim 11, characterised in that the grasping means (25) comprises a grommet fastened to a releasable covering piece (9, 23).

* * * * *

UNITED STATES PATENT AND TRADEMARK OFFICE

CERTIFICATE OF CORRECTION

PATENT NO. : 6,116,979
DATED : September 12, 2000
INVENTOR(S) : Jean-Marc Weber

It is certified that error appears in the above-identified patent and that said Letters Patent is hereby corrected as shown below:

Column 6,
Line 8, delete second occurrence of "covering pieces"

Column 7,
Lines 3-4, delete "claim 10, characterised in that" replace with -- claim 1, wherein --

Column 8,
Lines 3-4, delete "characterised in that" replace with -- wherein --

Signed and Sealed this

Sixth Day of November, 2001

*Attest:*

Nicholas P. Godici

*Attesting Officer*

NICHOLAS P. GODICI
*Acting Director of the United States Patent and Trademark Office*